United States Patent [19]

Engel

[11] Patent Number: 5,064,171

[45] Date of Patent: Nov. 12, 1991

[54] DRIVE HEAD FOR A SCISSORS JACK

[75] Inventor: Darryl L. Engel, LaOtto, Ind.

[73] Assignee: Universal Tool & Stamping Co., Inc., Butler, Ind.

[21] Appl. No.: 587,068

[22] Filed: Sep. 24, 1990

[51] Int. Cl.[5] ..... B66F 3/12

[52] U.S. Cl. ..... 254/126; 254/1; 254/DIG. 3; 411/3; 411/410; 411/409; 411/403

[58] Field of Search ..... 254/7 B, 122, 126, DIG. 3, 254/1; 81/121.1; 411/2, 3, 5, 410, 409, 402, 403, 404, 919, 6, 503

[56] References Cited

U.S. PATENT DOCUMENTS

| | | | |
|---|---|---|---|
| 1,094,768 | 4/1914 | Zerk | 411/409 |
| 3,709,087 | 1/1973 | Stone | 411/6 |
| 4,636,125 | 1/1987 | Burgard | 411/410 |
| 4,802,653 | 2/1989 | Engel . | |
| 4,964,602 | 10/1990 | Reinhard | 411/402 |

FOREIGN PATENT DOCUMENTS

| | | | |
|---|---|---|---|
| 663313 | 4/1929 | France | 254/126 |
| 2223735 | 4/1990 | United Kingdom | 254/126 |

*Primary Examiner*—Robert C. Watson

*Attorney, Agent, or Firm*—Hill, Van Santen, Steadman & Simpson

[57] ABSTRACT

A drive head for the screw of a scissors jack which is formed in the shape of a wing nut which has a hexagonal socket formed between opposed walls so that a conventional folding lug wrench can be used by inserting its hex tube into the hexagonal socket to drive it. In the event of overload, the lug wrench will slip relative to the wing nut so as to prevent excessive loads and stresses upon the jack.

4 Claims, 1 Drawing Sheet

DRIVE HEAD FOR A SCISSORS JACK

BACKGROUND OF THE INVENTION

1. Field of the Invention

This invention relates in general to a scissors jack and in particular to an improved drive mechanism.

2. Description of the Prior Art

U.S. Pat. No. 4,802,653 illustrates a scissors-type jack which can be raised and lowered with a folding lug wrench which has a handle that is pivotally connected to a tube that has a hexagonal opening and a hexagonal outer contour. In such jacks, the hexagonal tube fits over the hexagonal hex head on a threaded screw such that as the threaded screw is rotated with the lug wrench, the jack can be raised and lowered.

The hex head of the screw is the same size as the lug nuts and the hex tube of the folding lug wrench fits over the hex head of the screw.

With such prior art scissors jack, it is possible to overload the jack by exerting too much torque on the hex head of the threaded screw of the jack so as to bend or break the jack.

SUMMARY OF THE INVENTION

It is an object of the present invention to provide a novel drive head for the drive screw of a scissors jack.

It is a feature of the present invention to provide a new drive head for a scissors jack which is provided with a socket into which the outer diameter of a hex-shape tube of a folding lug wrench can be received so as to raise and lower the jack. The new drive head is in the general shape of a wing nut which can be operated by the users fingers so as to raise the jack until it engages the vehicle after which the folding lug wrench is used. When lowering the vehicle, the jack is unloaded and the user can then use his fingers to finish the lowering the jack into its storage position.

The hex tube of the folding lug wrench slips inside the hex wing nut so as to turn the screw of the jack and with the novel design of the invention if the jack is overloaded the hex wing nut will spread open and the hex tube of the folding lug wrench will slip without turning the jack drive screw. Thus, the present invention prevents the jack from being overloaded. Even though the hex tube slips in the hex wing nut, the jack will still be functional and the present invention provides a jack with a non-destructive failure mode so as to prevent the jack from being overloaded. This is an important safety factor, since overloading the jack is dangerous.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
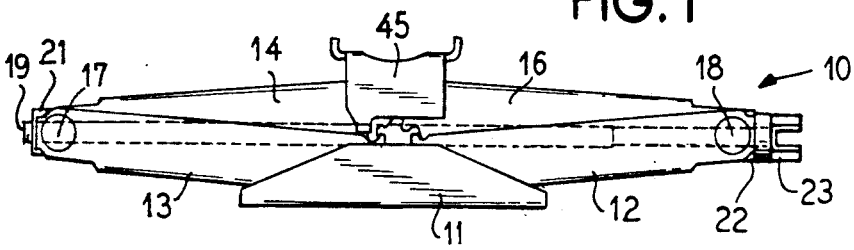
FIG. 1 is a side elevational view of the jack of the invention.
Figure 2:
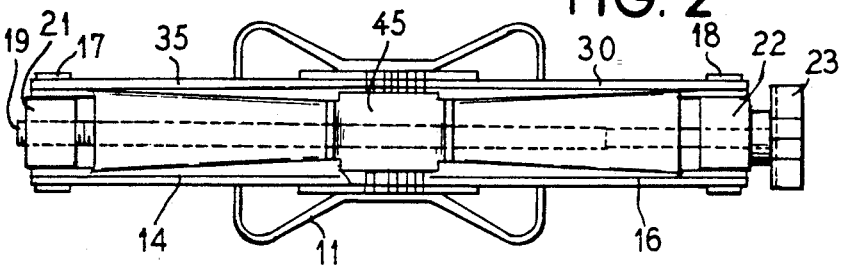
FIG. 2 is a top elevational view of the jack of the invention.
Figure 3:
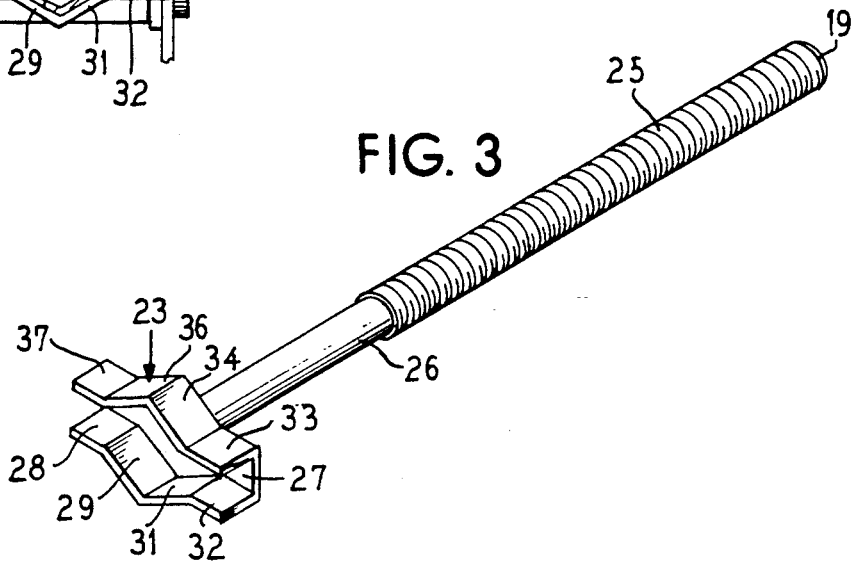
FIG. 3 is a perspective view of the drive screw with the novel wing nut head attached thereto.
Figure 3:
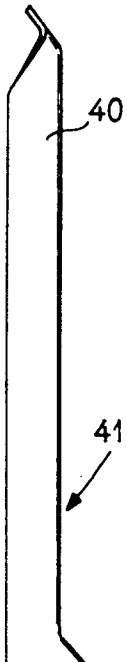

FIGS. 1–5 illustrate the invention which comprises a novel drive head for a scissors jack. FIGS. 1 and 2, for example, are respectively the side plan and top plan view of a scissors jack in which the novel drive head has been installed. As shown in Pat. No. 4,802,653, a scissors jack has a base 11 with two pair of lower pivot arms such as 12 and 13 illustrated in FIG. 1 which are pivotally connected by pivot pins 17 and 18 to two pair of upper scissor arms 14 and 16 and 30 and 35. A load carrying member 45 is pivotally connected to the upper arms such as shown in FIGS. 1 and 2. A threaded member 21 is received on pivot pin 17 and threadedly receives a bolt shaft 19 which lowers and raises the jack. FIG. 3 illustrates the bolt 19 which has a threaded portion 25 adjacent one end and a non-threaded portion 26 adjacent the other end and has the novel drive head 23 connected to the other end. The novel drive end 23 is in the form of a thumb screw which can be manually manipulated by a user and has a back plate 27 which is welded or otherwise attached to the end of the shaft 19 adjacent the portion 26. A generally hexagonal opening is formed by members 34, 36 and 29 and 31 which are spaced from each other as shown. A horizontal extending portion 37 extends from portion 36 and a horizontal portion 33 extends from portion 34. A horizontal portion 28 parallel to portion 37 extends from portion 29 and a horizontal portion 32 extends from portion 31 and is parallel to portion 33.

Portions 28, 32, 33 and 37 with the center hexagonal portion of the drive head 23 form a thumb screw which can be turned manually by an operator to raise the jack when it is not under load and to lower and close the jack for storage.

Figure 4:
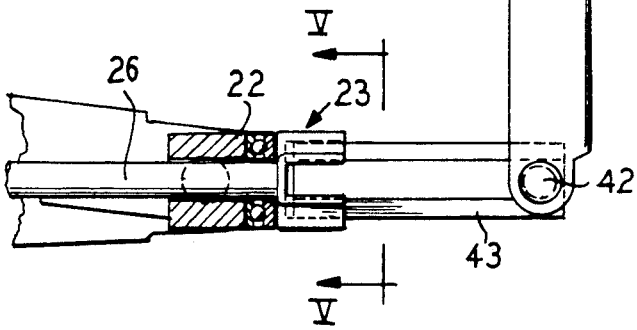
FIG. 4 is a sectional view showing the hex lug wrench engaged with the wing nut.
Figure 5:
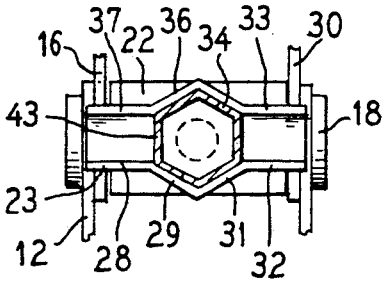
FIG. 5 is a sectional view taken on line V—V of FIG. 4.

FIG. 4 illustrates a handle 41 which has a first lever portion 40 which is pivotally connected by a pivot pin 42 to a hex tube 43. The hex tube 43 has an inside diameter which is of the same size as the hex nut on the end of the drive screws for conventional jacks such as shown in Pat. No. 4,802,653. In use with such conventional jacks, the hex head of the screw is received inside the hex tube 43 so that it can be driven by rotating the wrench 41 with the handle 40. In the present invention, the opening formed in the wing nut-shaped handle 23 between the portions 29, 31, 34 and 36 is such that the outside diameter of the hex tube 43 fits in the wing nut 23 as shown in FIGS. 4 and 5, for example, so that the wrench 41 can be used to raise and lower the jack. However, in the present invention, the torque which is applied to the drive screw 19 is limited because an excessive torque will cause the hex tube 43 to slip inside the hex wing nut 23 so that the shaft 19 will not be rotated under such conditions of excessive load.

With the invention, if the jack is overloaded, the hex wing nut 23 will spread open so that the members 29 and 31 move away from the members 34 and 36 and the hex tube 43 will slip out of the wing nut 23. However, such overload does not render the jack non-functional in that when the overload is removed, the hex tube 43 can be used to drive the bolt 19 without slipping.

It is seen that this invention provides a new and novel drive head for the drive screw of a scissors-type jack and although the invention has been described with respect to preferred embodiments, it is not to be so limited as changes and modifications can be made which are within the full intended scope of the invention as defined by the appended claims.

What is claimed is:

1. A scissor jack formed with a base and two pair of lower links with first ends pivotally attached to said base, a lifting cap and two pair of upper links pivotally attached to said lifting cap, second ends of one pair of said lower links pivotally attached to second ends of one pair of said upper links, second ends of another pair of said lower links pivotally attached to second ends of another pair of said upper links, a threaded collar mounted on the pivot of the second ends of said one pairs of upper and lower links, a thrust baring mounted on the pivot of said second ends of said other pairs of said upper and lower links, a threaded shaft receivable through said thrust bearing and threadedly received in said threaded collar, and a thumb screw attached to the end of said threaded shaft adjacent said thrust bearing for turning said threaded shaft so as to raise and lower said jack, wherein said thumb screw is formed with an opening into which a lug wrence can be inserted so as to turn said threaded shaft, and wherein said thumb screw if formed with flexible walls about said opening so that said lug wrench can turn relative to said threaded shaft under overload conditions.

2. A scissor jack according to claim 1 wherein said thumb screw is formed with a first planar member which is attached to the end of said threaded shaft, a pair of handle members attached to said first planar member and formed with end portions which are parallel to each other and with center portions which form a wrench receiving portion.

3. A scissor jack according to claim 2 wherein said wrench receiving portion forms a generally hexagonal opening for receiving said lug wrench which has a hexagonal portion.

4. A scissor jack according to claim 3 wherein overload torque causes said wrench receiving portion to deform so that said hexagonal portion of the lug wrench turns in the hexagonal opening of said wrench receiving portion.

* * * * *